United States Patent [19]

Howseman, Jr. et al.

[11] Patent Number: 4,859,073

[45] Date of Patent: Aug. 22, 1989

[54] FLUID AGITATOR AND PUMP ASSEMBLY

[76] Inventors: William E. Howseman, Jr., 150 E. Los Angeles Ave., #205, Moorpark, Calif. 93021; Harold J. Engel, 18932 Olympia St., Northridge, Calif. 91326

[21] Appl. No.: 228,454

[22] Filed: Aug. 5, 1988

[51] Int. Cl.[4] ..... B01F 15/02

[52] U.S. Cl. ..... 366/195; 366/190; 366/246; 366/252; 366/295; 417/201

[58] Field of Search ..... 366/249, 245, 246, 247, 366/250, 251, 252, 267, 270, 293, 294, 295, 296, 184, 190, 194, 195, 196, 262; 417/199.1, 199.2, 201, 203, 205

[56] References Cited

U.S. PATENT DOCUMENTS 855,631 6/1907 Greth ..... 366/196

912,852 2/1909 Johnson ..... 366/296

969,120 8/1910 Shapleigh ..... 366/296

2,298,317 10/1942 Smith ..... 366/296

4,475,820 10/1984 Mulligan ..... 366/184

*Primary Examiner*—Robert W. Jenkins

*Attorney, Agent, or Firm*—Linval B. Castle

[57] ABSTRACT

A fluid agitator and pump assembly for thoroughly mixing fluids with heavier materials that settle to the bottom of the chamber. The chamber is tubular and stands vertical with two motors on the top surface; one motor rotates an axial tube having radial mixing blades at the chamber bottom, the second motor drives a coaxial shaft running through the tube to a pump. In one embodiment, the pump is a piston pump and the second motor reciprocates a piston on the bottom of the coaxial shaft. In a second embodiment, the second motor rotates the drive shaft for driving a rotary pump.

12 Claims, 2 Drawing Sheets

FLUID AGITATOR AND PUMP ASSEMBLY

BRIEF SUMMARY OF THE INVENTION

This invention relates to fluid agitators and pumps and in particular to a system which will simultaneously mix a heavy nonsoluble material with a fluid and pump the mixture from the container.

Difficulties are encountered in mixing thin liquids with heavy thick nonsuluble materials because the fast settling time of the nonsoluble materials. If not thoroughly mixed, pumping from the bottom of a container will yield only the thick material only partially mixed with the liquid and this thick mixture will often clog the pumping apparatus. If the mixture is pumped from a location above the bottom of the container, pumping will yield the thin liquid improperly mixed with the heavier material at the bottom.

The invention to be described provides for a thorough mixing of thin liquids with heavy thick materials and the simultaneous pumping of the mixture from the bottom of the container.

Briefly described, the invention includes a vertical cylindrical container having a rotatable tube axially extending therethrough and supporting vertically aligned radial mixing blades that extend to within a fraction of an inch from and floor and side wall of the container. Within this rotatable blade driving tube is a shaft that may either rotate a pump centrally located under the floor of the container, or may drive a reciprocating piston of a pump mechanism axially formed above the interior floor of the container. Thus, fluid is mixed with the rotating tube and blades as the mixture is being pumped from an axial opening in the floor of the container.

DESCRIPTION OF THE DRAWINGS

In the drawings which illustrate the preferred embodiments of the invention.

DETAILED DESCRIPTION

Figure 1:
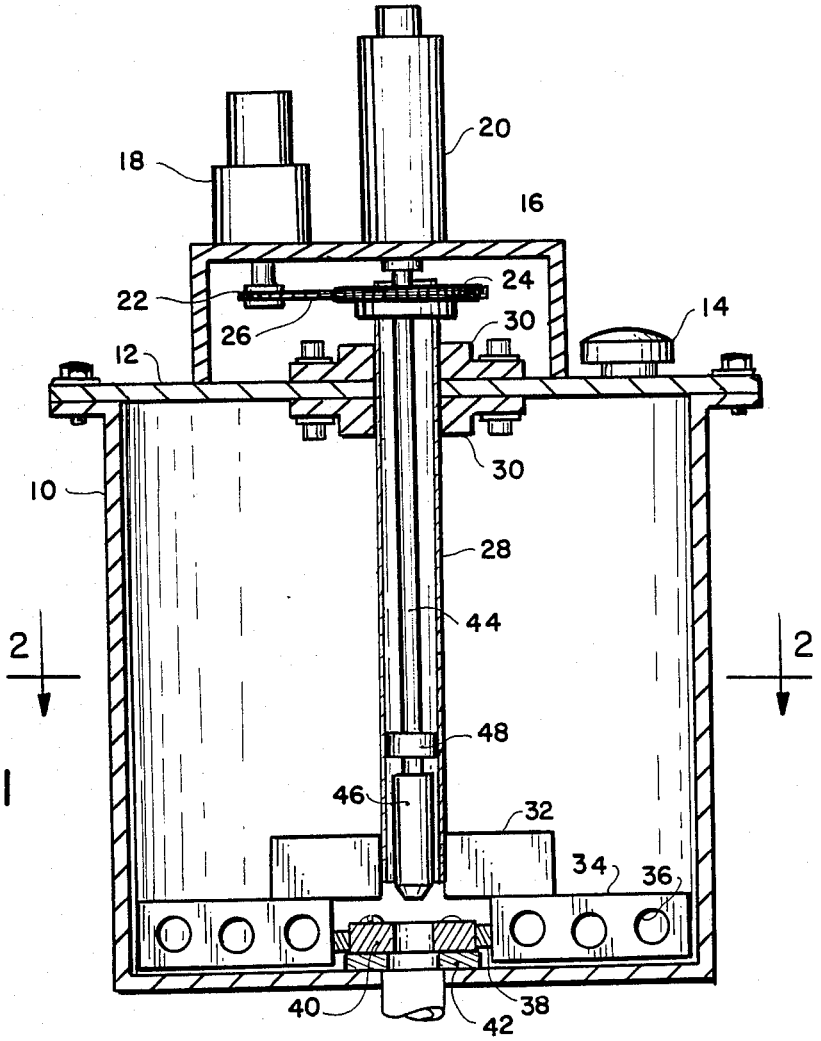
FIG. 1 is a sectional elevational view of a fluid mixing and piston pump mechanism.
Figure 2:
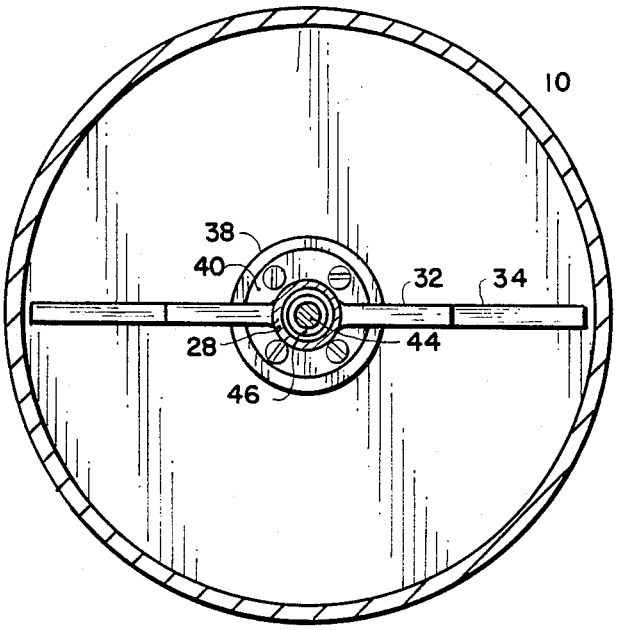
FIG. 2 is a plan view taken along the lines 2—2 of FIG. 1.

Illustrated in FIG. 1 is a vertical cylindrical container 10 which may be steel and have a diameter and height of approximately 18 inches. The container sides are formed with a lip at the top edge so that it may be bolted to a circular steel cover plate 12 that should be provided with a fluid filling opening and cap 14. Bolted to the top surface of the cover plate 12 is a frame 16 having a motor support deck normal to the longitudinal axis of the container 10. The deck supports two motors, a variable speed motor 18 having an output shaft parallel with but offset from the axis of the container, and a second motor 20 having its output shaft on the axis of the container. The output shaft of the second motor 20 of FIG. 1 is linearly driven and rotation of its shaft is not required; therefore the second motor may be an solenoid and is preferably an air piston or pneumatic piston motor 20.

The output shaft of the variable speed motor 18 drives a small gear or sprocket 22 which is coupled to a larger gear or sprocket 24 either by direct gear coupling or by a chain 26. The rotational speed of the motor 18 and the subsequent gear reduction should provide a rotational speed of the larger sprocket 24 of between about 30 to 200 r.p.m. The larger sprocket 24 is connected to the axial tube 28 which enters into the container through bearings or bushings 30 secured to the top and bottom surfaces of the cover plate 12. The tube 28 coaxially extends the the container to a point about two to three inches above the interior floor of the container and is welded at that point to a pair of coplaner vertically aligned blade support plates 32 that extend outward from the tube to a position about half way to the interior wall of the cylindrical container. Welded to the lower edges of the support plates 32 are the agitator blades 34, the lower edges of which extend to within about one quarter inch from the interior floor of the container and the outer edge extends to within about one quarter inch of the container wall so that virtually all heavy nonsoluble material at the bottom of the container will be stirred by the rotating blades. To improve the mixing ability, the agitator blades 34 may have several holes 36, as shown. If desired, the blades may have an angular pitch for drawing heavy materials up from the bottom of the chamber or for forcing fluids down into the heavy material.

Because rotation of the agitator blades 34 in a heavy material may easily force the blades at the end of an 18 inch tube 28 into contact with the wall of the container, it is necessary to provide support for the blades. The agitator blades are coplanar and radially extend outward from the axis of the cylinder, but the blade edges adjacent the cylinder axis are spaced about $2\frac{1}{2}$ inches from the axis, or spaced about 5 inches from each other. Welded to the adjacent inner edges of the agitator blades 34 is a circular ring bushing 38 the smooth inner surface of which is in bearing contact with the exterior of a circular ring, designated a pump ring 40. The pump ring is bolted to a sole plate 42 which is welded to the interior floor of the container 10. Both the pump ring 40 and sole plate 42 have central holes each coaxial with the axis of the container, as will be later discussed. Thus, the pump ring 40 and hence the ring bushing 38 and agitator blades are secured against radial movement and wobble that could damage the agitator blades.

The second or pneumatic piston motor 20 secured to the cover plate frame 16 is coupled to an axially driven steel shaft 44 which extends through the center of the agitator blade drive tube 28. The lower end of the shaft 44 is connected to an elongated piston 46 which can easily fit within the bore of the tube 28. The diameter of the piston 46 is substantially the same as the diameter of the hole in the previously mentioned pump ring 40 and slightly smaller than the hole in the sole plate 42 so that the piston 46 passing into the pump ring 40 hole operates as a piston pump to drive a mixture in the container through an axial opening and exhaust pipe in the floor of the container. To assist in guiding the piston and to prevent radial movement of the piston off of the container axis, a toroidal Nylon or Teflon centering bushing 48 may be applied between the shaft 44 and bore of the tube 28.

Figure 3:
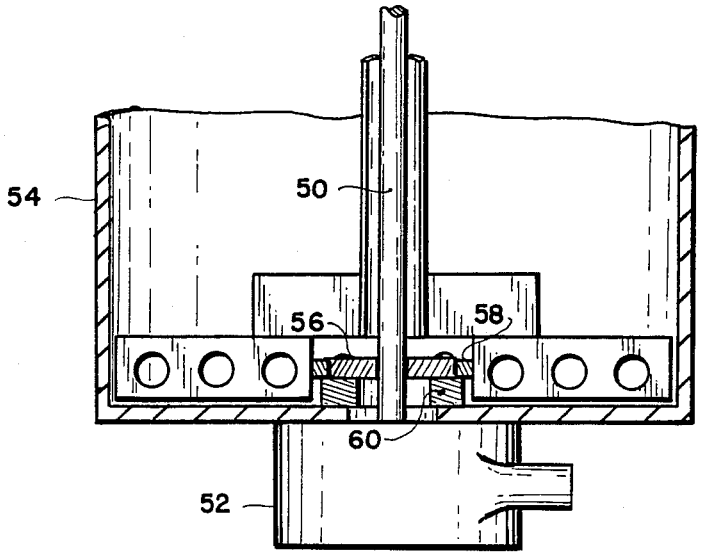
FIG. 3 is a sectional elevational view of a portion of the fluid mixing and rotating pump mechanism.

FIG. 3 is a drawing illustrating the lower portion of a chamber 54 adapted for use with a rotary pump 52 centrally attached to exterior floor of the chamber. The agitator drive and blade assembly is identical to that described above except that the previously discussed pump ring 40 and sole plate 42 are different as will be subsequently explained.

In the rotary pump system of FIG. 3, the pump is driven by a rotatable motor and shaft 50 which passes through the floor of the chamber 54 to the pump. If the pump 52 is secured to the external floor of the chamber, it may have input shaft bearings that will prevent wobble of the lower end of the shaft. However, if the shaft 50 is couple directly to the pump rotor, the lower end of the shaft must be braced in a bearing or bushing to prevent radial wobble of the shaft.

To prevent such wobble of shaft 50, the former pump ring 40 has been replaced with a bearing disc 56 having a smooth exterior for engagement with the agitator plate ring bushing 58 and also a smooth inner bushing surface for bearing engagement with the rotatable shaft 50. The bearing disc 56, together with a toroidal sole plate, therefore operate to substantially seal off the chamber from the chamber exit opening. To prevent such a sealing of the chamber exit an open face sole plate 60, shown in detail in FIG. 4 may be used.

Figure 4:
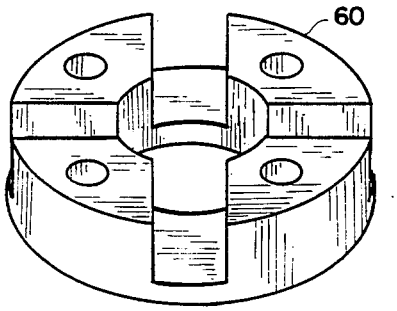
FIG. 4 is a detailed schematic diagram of the bearing ring and sole plate illustrated in FIG. 3.

FIG. 4 illustrates a sole plate that permits a flow of mixture from within the chamber to enter the pump 52. The circular plate has a plurality of mixture entrance openings in the side wall and a central opening for the passage of the shaft 50 and mixture to the pump 52, as shown in FIG. 3. The entrance openings of the sole plate are cut only through the top surface and sufficient circular material remains on the bottom surface of the sole plate so that it can be welded or otherwise attached to the interior floor of the chamber.

Having thus described the invention, what is claimed is:

1. A fluid agitator and pump assembly comprising:

a mixing chamber having a top, side walls, and a substantially circular floor with a centrally located fluid exit opening therein;

a tubular shaft within said chamber said shaft being aligned with said fluid exit opening;

at least one mixing blade attached to said tubular shaft, said blade having a bottom edge and outer edges respectively spaced from and adjacent to the interior floor and walls of said chamber;

first means at the top of said chamber for rotating said tubular shaft; and second means at the top of said chamber and coupled to a drive shaft extending through said tubular shaft for driving a mixture pump at the bottom of said chamber.

2. The fluid agitator and pump assembly claimed in claim 1 wherein said mixing blade has openings therein to facilitate mixing of heavy material with fluids in said chamber.

3. The fluid agitator and pump assembly claimed in claim 2 wherein said blade is a plurality of blades, each of the plurality having inner edges coupled to the exterior of a circular ring having an interior bearing surface in rotational contact with the exterior surface of a stationary toroidal member secured to the floor of said chamber.

4. The fluid agitator and pump assembly cleimed in claim 3 wherein said first means is a first motor located on the top of said chamber, said motor having a rotatable motor output shaft.

5. The fluid agitator and pump assembly claimed in claim 4 wherein said tubular shaft is coupled through at least one bushing in the top of said chamber, the portion of the tubular shaft extending above said bushing and chamber top being coupled to said first motor by gear means.

6. The fluid agitator and pump assembly claimed in claim 5 wherein said gear means comprises chain and sprockets.

7. The fluid agitator and pump assembly claimed in claim 5 wherein said drive shaft has first and second ends, the first end of said drive shaft extending through the top end of said tubular shaft and coupled to said second means, said second means being a reciprocating second motor, said second end of said drive shaft terminating in a piston which cooperates with the central opening in said stationary toroidal member secured to the interior floor of said chamber to form piston pumping means.

8. The fluid agitator and pump assembly claimed in claim 7 wherein said reciprocating second motor is pneumatically operated.

9. The fluid agitator and pump assembly claimed in claim 8 wherein the second end of said drive shaft is provided with a centering bushing slidably engaging the bore of said tubular shaft for for assuring alignment of said piston in central opening of said toroidal plate.

10. The fluid agitator and pump assembly claimed in claim 5 wherein said drive shaft has first and second ends, the first end of said drive shaft extending through the top end of said tubular shaft and coupled to said second motor, said second motor being a rotatable motor, said second end of said drive shaft terminating in a rotary pump coupled to the floor of said cylinder for receiving fluid from said chamber.

11. The fluid agitator and pump assembly claimed in claim 10 wherein the second end of said drive shaft is secured against radial movement by an inner bearing surface in said central opening in said toroidal plate, and wherein a sole plate having a central opening is secured to the interior floor of said chamber for securing thereon said toroidal plate.

12. The fluid agitator and pump assembly claimed in claim 10 wherein said sole plate has apertures through the side walls and top surface to enable the passage of a mixture from the chamber exit opening.

* * * * *